US009937367B1

(12) United States Patent
Huang et al.

(10) Patent No.: US 9,937,367 B1
(45) Date of Patent: Apr. 10, 2018

(54) ADJUSTABLE FALLING FOOT SUPPORT DEVICE

(71) Applicants: Yung-Chung Huang, Changhua County (TW); George J Stallings, Ashburn, VA (US); Todd Olson, Winlock, WA (US)

(72) Inventors: Yung-Chung Huang, Changhua County (TW); George J Stallings, Ashburn, VA (US); Todd Olson, Winlock, WA (US)

( * ) Notice: Subject to any disclaimer, the term of this patent is extended or adjusted under 35 U.S.C. 154(b) by 0 days.

(21) Appl. No.: 15/389,434

(22) Filed: Dec. 22, 2016

(51) Int. Cl.
*A62B 35/00* (2006.01)

(52) U.S. Cl.
CPC ..... *A62B 35/0025* (2013.01)

(58) Field of Classification Search
CPC . A62B 35/00; A62B 35/0025; A62B 35/0093; A62B 35/0006; A62B 35/0018; A62B 1/10; A41F 9/025; A41F 19/00; A41F 3/00; A63B 21/0004; A63B 21/055; A63B 21/0552; A63B 21/0557; A63B 21/4023; A63B 21/4025
See application file for complete search history.

(56) References Cited

U.S. PATENT DOCUMENTS 3,869,021 A * 3/1975 Sutherland ..... A62B 35/0018 182/135
2007/0278036 A1* 12/2007 Barta ..... A62B 35/0018 182/3
2009/0260922 A1* 10/2009 Marquardt ..... A62B 1/10 182/232
2011/0315482 A1* 12/2011 Griffiths ..... A62B 1/08 182/231
2011/0315483 A1* 12/2011 Griffiths ..... A62B 1/10 182/232
2012/0267198 A1* 10/2012 Chowthi ..... A62B 1/10 182/231
2013/0105247 A1* 5/2013 Casebolt ..... A62B 1/10 182/241
(Continued)

*Primary Examiner* — Katherine W Mitchell
*Assistant Examiner* — Shiref M Mekhaeil
(74) *Attorney, Agent, or Firm* — Raymond Y. Chan; David and Raymond Patent Firm

(57) ABSTRACT

The present invention comprises a shell, a fixing arrangement, a belt pulley, a main belt, and a breaking arrangement. The shell comprises a compartment defined therein and a belt outlet thereon. The compartment has an opening facing upward. The fixing arrangement detachably buckles the shell on safety harness. The belt pulley is pivotally arranged in the compartment by an axis and defines a winding room. The main belt is coiled in the winding room and has a first end affixed in the winding room, a second end pulled out from the shell through the belt outlet, and a supporting portion provided between the first end and the second end. The breaking arrangement comprises a plurality of blocks spacingly arranged on the shell, a first guiding groove radially arranged on the belt pulley, and a slider slidingly arranged in the first guiding groove to shift between a first position and a second position, such that when the slider shifts to the second position, the pulling position of the supporting portion is adjustable and when the slider shifts to the first position, the supporting portion is positioned for the user to step when hanging in the air.

14 Claims, 7 Drawing Sheets

(56) References Cited

U.S. PATENT DOCUMENTS

| | | | | |
|---|---|---|---|---|
| 2014/0138186 | A1* | 5/2014 | Macy | A62B 35/0093<br>182/237 |
| 2015/0251057 | A1* | 9/2015 | Frankhauser | A63B 29/02<br>182/134 |
| 2016/0236017 | A1* | 8/2016 | Gross | A62B 35/0025 |
| 2016/0236018 | A1* | 8/2016 | Chen | A62B 35/0093 |

* cited by examiner

ADJUSTABLE FALLING FOOT SUPPORT DEVICE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention provides an adjustable foot support device that can be assembled on a safety harness or belt for personnel hung in the air to step on.

Description of Related Arts

In high altitude circumstances, such as rock climbing, mountaineering, construction, etc., personnel must wear safety harness or belt that carries anti-falling device so as to be hung in the high altitude with the anti-falling device. Therefore, when the personnel accidentally falls, the anti-falling device can buffer the falling speed and hang the personnel in the air for later rescue.

The actual structure of a conventional safety harness includes what have been disclosed in the prior arts of Taiwan Patent Numbers 105211908, 104210161, and 102212108. The conventional safety harness mainly ties the thigh of the user to have the safety harness bear the user's weight and hang the user in the air. As a result, it causes an issue of concentration of stress and renders ills, including bruises and muscular aches on the upper thigh of the personnel. Especially if the subsequent rescue is delayed, the personnel hanging in the air will have to bear huge pain.

Because of this, the present inventor has elaborately conducted his research and development and eventually come up with the present invention to improve on the issue of concentration of stress on the upper thigh of the personnel hung in the air by conventional safety harness.

SUMMARY OF THE PRESENT INVENTION

The present invention provides an adjustable falling foot support device, comprising:

a shell, comprising a compartment defined therein and a belt outlet thereon, wherein the compartment has an opening facing upward;

a fixing arrangement, detachably buckling the shell on safety harness;

a belt pulley, pivotally arranged in the compartment by an axis and defining a winding room communicating the belt outlet;

a main belt, coiled in the winding room, wherein the main belt has a first end affixed in the winding room, a second end pulled out from the shell through the belt outlet, and a supporting portion provided between the first end and the second end; and a breaking arrangement, comprising a plurality of blocks spacingly arranged on the shell, a first guiding groove radially arranged on the belt pulley, and a slider slidingly arranged in the first guiding groove to shift between a first position and a second position, such that when the slider shifts to the second position, the pulling position of the supporting portion is adjustable and when the slider shifts to the first position, the supporting portion is positioned for the user to step when hanging in the air.

Accordingly, the present invention can certainly improve on the issue of concentration of stress on the upper thigh of the personnel hung in the air by conventional safety harness and help to eliminate ills, including bruises and muscular aches on the thigh of the personnel. Hence, the present invention provides real enhancement.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
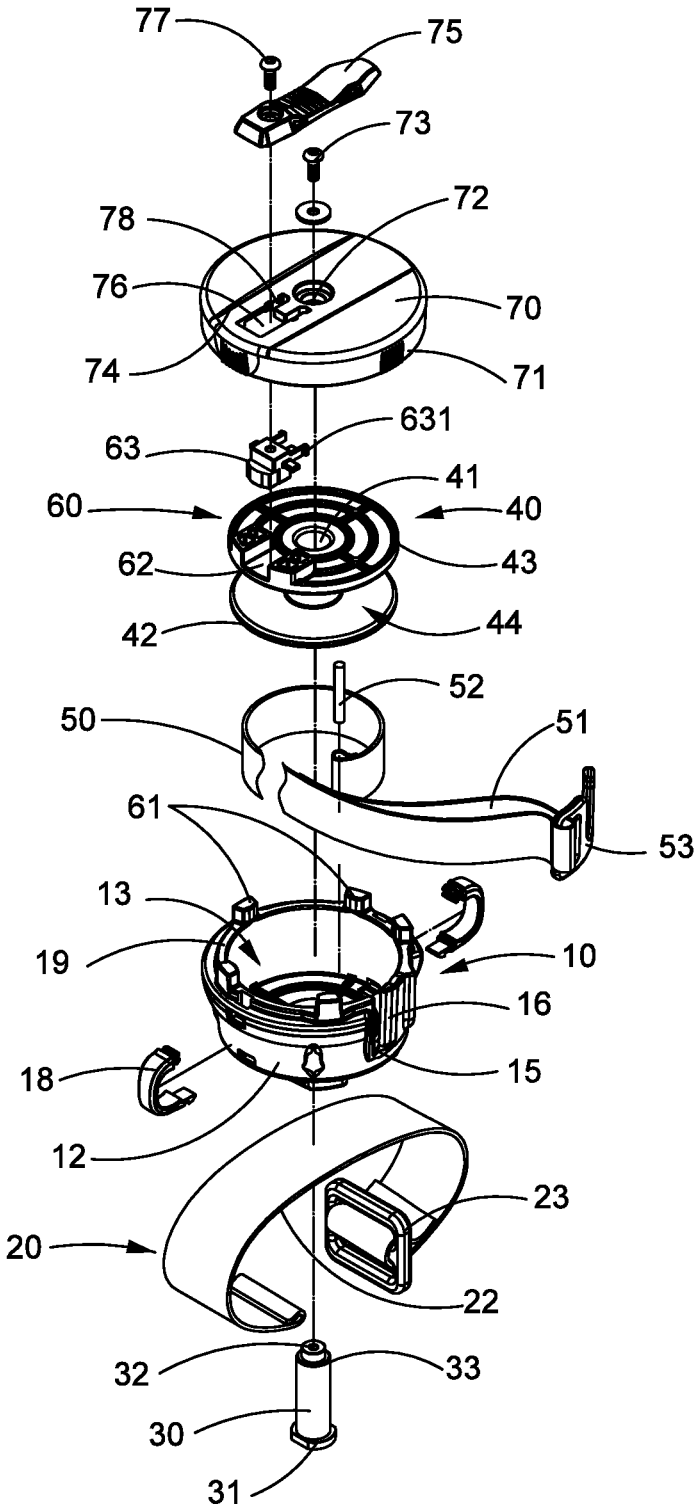
FIGS. 1 and 2 are exploded views of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1-9, the device according to the present invention comprises a shell 10, a fixing arrangement 20, an axis 30, a belt pulley 40, a main belt 50, a breaking arrangement 60, and a screw cap 70.

Figure 8:
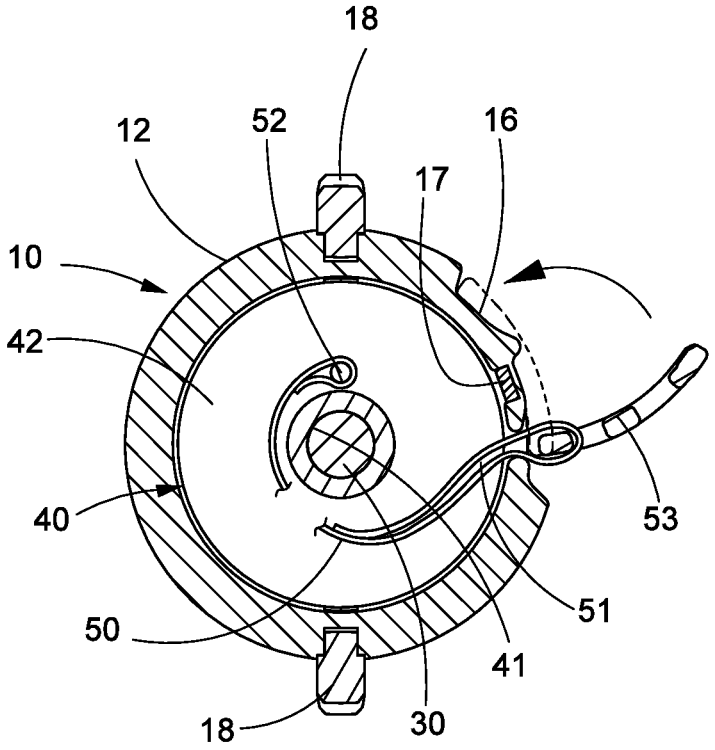
FIG. 8 is a perspective view illustrating an action of the forcing portion according to the present invention.

The shell 10 is a round base plate 11 that extends the periphery thereof upwards to form a trunk 12 and define a compartment 13 with an opening facing upwards. The center of the base plate 11 has a spline hole 14 penetrated through in a stair shaped manner. The trunk 12 has a belt outlet 15 penetrated thereon to communicate the inside and outside of the compartment 13. Referring to FIG. 8, the shell 10 further has a recess portion 16 formed on the outboard around the belt outlet 15 and a plurality of magnetic elements 17 embedded thereon. The periphery of the trunk 12 symmetrically has two lifting eyes 18 coupled thereon. These lifting eyes allow hand tools to be coupled therewith by ropes (not shown in the figures) for the personnel to utilize in the air. Besides, the trunk 12 further comprises a shoulder encircling portion 19 protruding from the inner periphery of the top margin thereof around the compartment 13.

Figure 2:
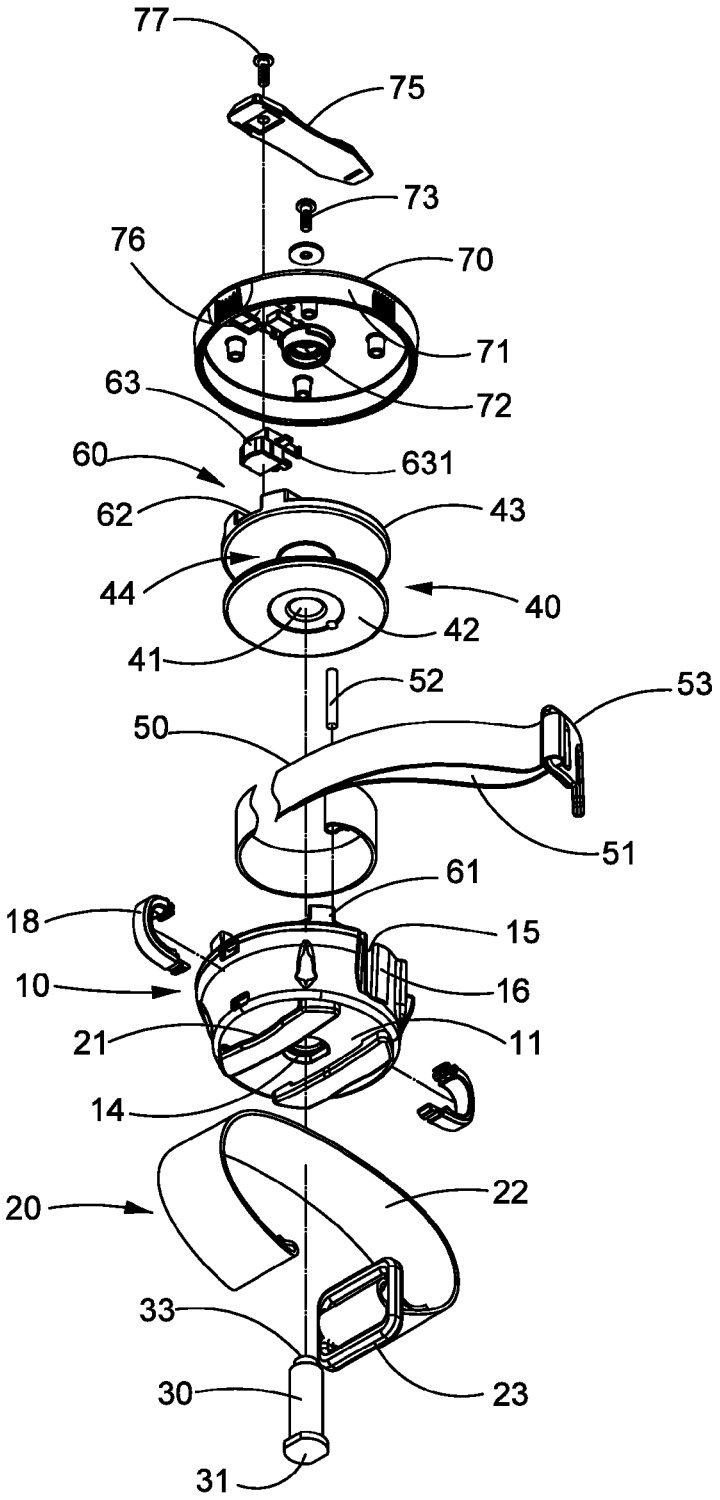
Figure 3:
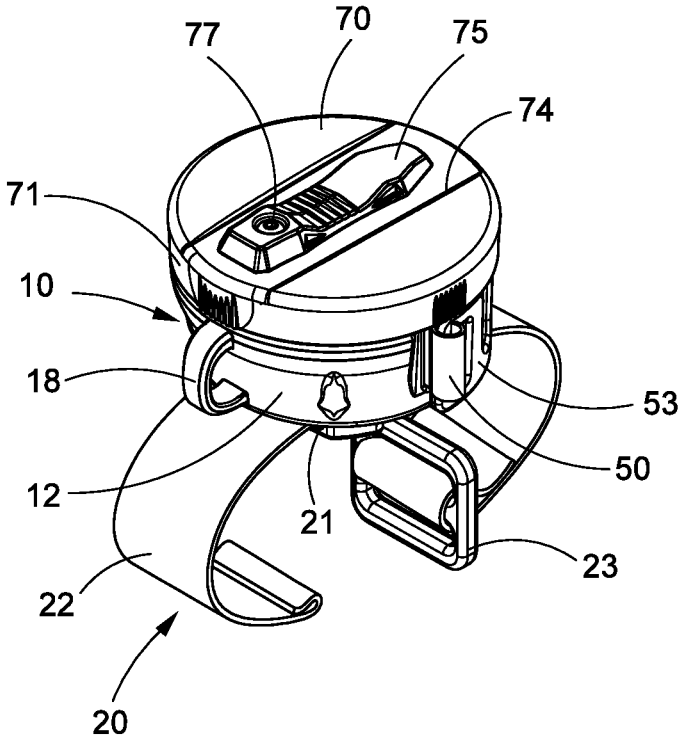
FIG. 3 is a perspective view illustrating an assembly of the present invention.
Figure 4:
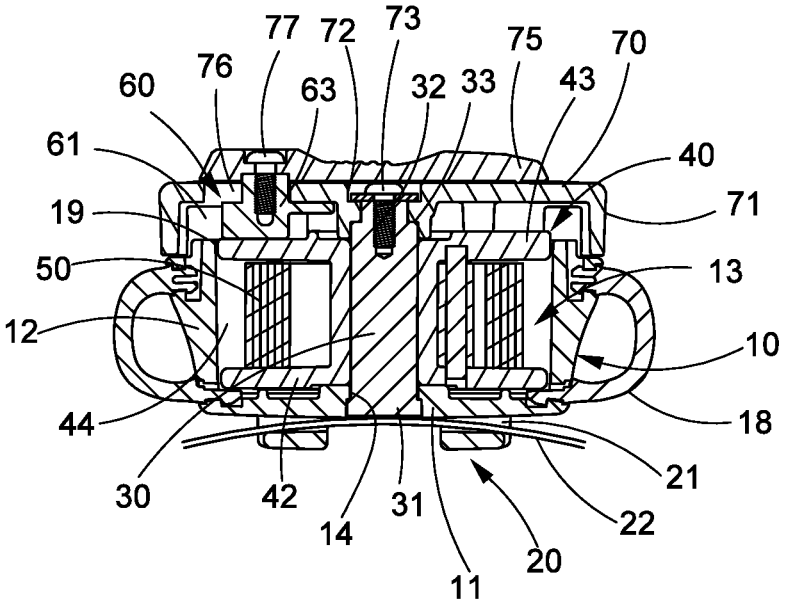
FIGS. 4 and 5 are sectional views illustrating the slider in an initial state (second position) according to the present invention.
Figure 5:
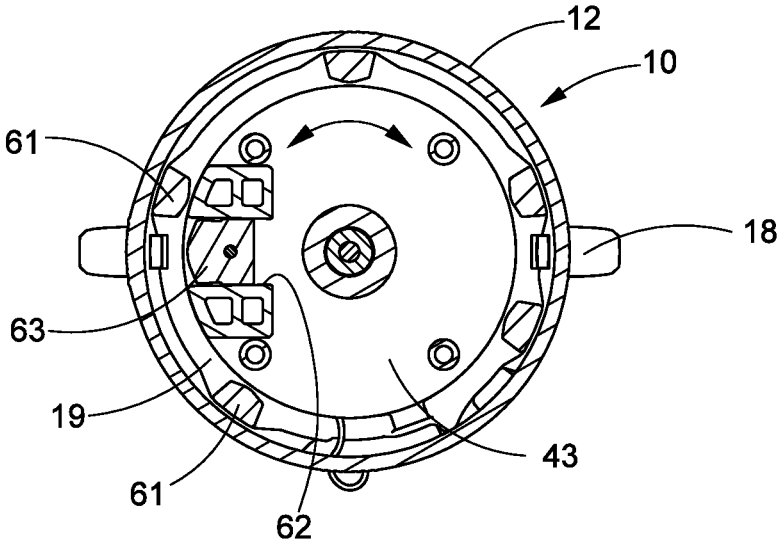
Figure 9:
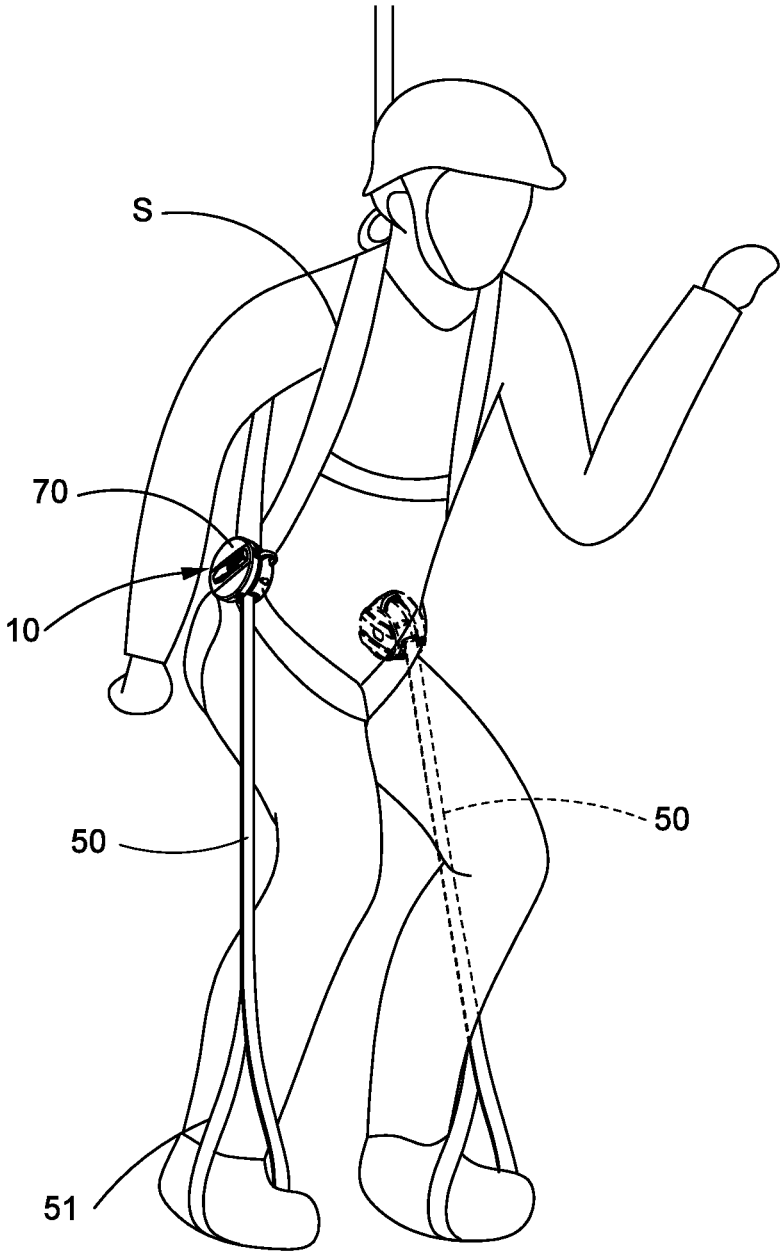
FIG. 9 is a perspective view according to an embodiment of the present invention.

The fixing arrangement 20, referring to FIGS. 2 and 3, comprises two belt slots 21 arranged on the bottom side of the base plate 11 and a fastening belt 22 penetrating the two belt slots 21. One end of the fastening belt 22 has a buckle 23 to buckle another end of the fastening belt 22 after it tied the safety harness S, as FIG. 9 illustrated. Therefore, the shell 10 can be detachably buckled to the safety harness S.

The axis 30 is perpendicularly arranged in the compartment 13. The bottom end of the axis 30 has a nut head 31 matching the spline hole 14, while the top end of the axis 30 respectively has a screw hole 32 and a retaining lip 33.

The belt pulley 40 is arranged in the compartment 13 and has a mid hole 41 for pivotally connection of the axis 30. The bottom end of the belt pulley 40 radially protrudingly provides a first plate 42, while the top end of the belt pulley 40 radially protrudes a second plate 43, such that the first plate 42 and the second plate 43 define a winding room 44 therebetween that communicates the belt outlet 15.

The main belt 50 is coiled in the winding room 44. The main belt 50 has a first end, an opposite second end, and a supporting portion for footstep provided between the first end and the second end. A pin 52 is arranged on the first end to bridge between the first plate 42 and the second plate 43, so that one end of the main belt 50 can be affixed on the belt pulley 40 and the second end of the main belt 50 can be pulled out from the shell 10 via the belt outlet 15. The second end of the main belt 50 also comprises a forcing portion 53 affixed thereon to facilitate the personnel to pull therewith. The forcing portion 53 is larger than the belt outlet 15 to restrict the second end of the main belt 50 from being withdrawn into the compartment 13. To help the forcing portion 53 to fit on the outboard of the shell 10 when the device is not in use and reduce the incongruity of the look, the forcing portion 53 further has magnetic conductibility so as to be attracted by the magnetic elements 17 and to be positioned at the recess portion 16, as FIG. 8 illustrated.

The breaking arrangement 60 comprises a plurality of blocks 61 arranged on the shoulder encircling portion 19 of the shell 10, a first guiding groove 62 radial arranged and defined on the top surface of the second plate 43 of the belt pulley 40, and a slider 63 slidingly arranged in the first guiding groove 62, so that the slider 63 can shift between a first position and a second position. When the slider 63 is at the first position, the outer edge of the slider 63 will be locked by a corresponding block 61 to stop the belt pulley 40 so that the belt pulley 40 is unable to autorotate around the axis 30, so as to stably restrict the main belt 50 from being freely pulled out from the belt outlet 15. However, when the slider 63 is shifted to the second position, the outer edge of the slider 63 will be escaped from the block 61, so that the main belt 50 can be pulled out from the belt outlet 15 easily, so as to drive the belt pulley 40 to autorotate around the axis 30. Hence, the user can adjust the pulled length of the main belt 50 by switching the slider 63 whether to the first position to, as FIG. 9 illustrated, customize the relative position of the supporting portion 51 for footstep. This improves on the issue of concentration of stress on the upper thigh of the personnel hung in the air by conventional safety harness and significantly eliminates ills, including bruises and muscular aches on the upper thigh of the personnel. Especially if the subsequent rescue is delayed, the effect of the present invention becomes more obvious.

The screw cap 70 covers the opening on the top of the compartment 13 to hide the belt pulley 40, so as to enhance the appearance of the device according to the present invention. The bottom of the screw cap 70 presses against the block 61 and the periphery of the screw cap 70 extends downwards to provide a rim 71. The rim 71 is pivotally connected with the outboard of the shoulder encircling portion 19. The screw cap 70 further has a mounting hole 72 penetrated. The bottom of the mounting hole 72 limits the retaining lip 33 on top of the axis 30. A stopping bolt 73 pivots through the mounting hole 72 to be locked on the screw hole 32 on top of the axis 30, so as to control the screw cap 70 to autorotate around the stopping bolt 73 and the axis 30. Besides, the screw cap 70 further has a sunk area 74 radially sunk on the top surface thereof, a control button 75 arranged in the sunk area 74, a second guiding groove 76 corresponding to the first guiding groove 62 in the area of the sunk area 74 that the top margin of the slider 63 is slidingly arranged in the second guiding groove 76, and a locking bolt 77 screwingly fixing the control button 75 on the top of the slider 63. Therefore, the screw cap 70 and the belt pulley 40 can integrally autorotate and the control button 75 can drive the slider 63 to shift between the first position and the second position. In addition, in order to prevent the screw cap 70 and the belt pulley 40 to accidentally contact the slider 63 and be locked by the block 61 due to the centrifugal force during autorotation, the slider 63 comprises a first clip portion 631 and the screw cap 70 further comprises a second clip portion 78 that matches the first clip portion 631, such that the first clip portion 631 and the second clip portion 78 limit each other by providing a preload, so as to overcome the above issue of accidentally contacting the slider 63 due to centrifugal force. The personnel can utilize the control button 74 to drive the slider 63 to the first position only when he or she overcomes the preload, such that the overall functioning stability can further be under control.

Figure 6:
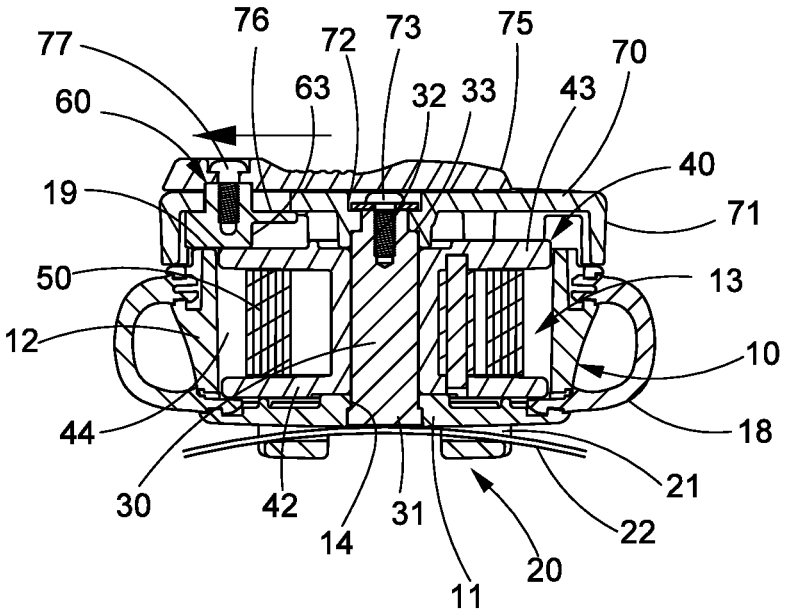
FIGS. 6 and 7 are sectional views illustrating the slider in a working state (first position) according to the present invention.
Figure 7:
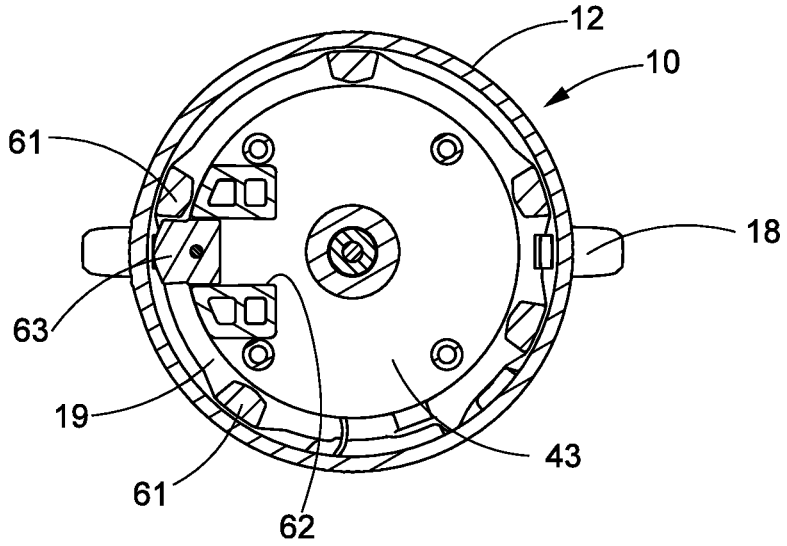

Referring to FIGS. 3-5 and 8, the device according to the present invention in the initial state utilizes magnetic elements 17 to attract the forcing portion 53 and position it on the shell 10. Therefore, even when the slider 63 is positioned at the second position, the main belt 50 will not drop off easily. Accordingly, when the user is hung in the air, he or she still has to overcome the attractive force between the forcing portion 53 and the magnetic elements 17 in order to pull out the main belt 50. Referring to FIGS. 6, 7, and 9, when the supporting portion 51 of the main belt 50 can just be provided for footstep, the slider 63 can be shifted to the first position to be locked by the corresponding block 61 on the shell 10, so as to effectively stop the belt pulley 40 and allow the supporting portion 51 to be provided for footstep. Hence, the issue of concentration of stress on the upper thigh of the personnel hung in the air by conventional safety harness can be improved on. In the same way, the device according to the present invention allows the main belt 50 to be rewound back to the winding room 44 of the belt pulley 40 for reuse of next time by just positioning the slider 63 to the second position.

To sum up, the overall structure and features of the present invention is completely new and novel to the prior arts. It allows personnel to step thereon when hung in the air, which design has never been published or seen in the field of similar products. Therefore, it meets the conditions and laws for patent application. However, the above descriptions are only a preferred embodiment of the present invention, but not to be used to confine the scope of embodying the present invention, which means all equivalent varieties and modifications based on the appended claims of the present invention are within the scope of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An adjustable falling foot support device, comprising:

a shell, comprising a compartment defined therein and a belt outlet thereon, wherein said compartment has an opening facing upward;

a safety harness for a user;

a fixing arrangement, detachably buckling said shell on said safety harness;

a belt pulley, pivotally arranged in said compartment by an axis and defining a winding room;

a main belt, coiled in said winding room, wherein said main belt has a first end affixed in said winding room, a second end pulled out from said shell through said belt outlet, and a supporting portion configured for receiving feet of said user to reduce stresses on upper thighs of said user provided between said first end and said second end; and a braking arrangement, comprising a plurality of blocks spacingly arranged on said shell, a first guiding groove radially arranged directly on said belt pulley, and a slider slidingly arranged in said first guiding groove to shift between a first position and a second position, such that when said slider shifts to said second position, a pulling position of said supporting portion is adjustable and when said slider shifts to said first position, said supporting portion is positioned for the user to step when hanging in the air.

2. The adjustable falling foot support device, as recited in claim 1, wherein said shell is a base plate that extends a periphery thereof to form a trunk and define said compartment with said opening facing upwards, wherein said trunk has said belt outlet penetrated thereon to communicate an inside and an outside of said compartment, wherein a bottom of said belt pulley radially protrudingly provides a first plate, while a top end of said belt pulley radially protrudingly provides a second plate, wherein said first plate and said second plate define said winding room therebetween, wherein said first guiding groove is arranged on said second plate.

3. The adjustable falling foot support device, as recited in claim 2, wherein said shell further comprises a recess portion formed on an outboard around said belt outlet and a plurality of magnetic elements thereon, wherein said second end of said main belt comprises a forcing portion affixed thereon so as to restrict said second end of said main belt from being withdrawn into said compartment, wherein said forcing portion is magnetic conductible so as to be attracted by said magnetic elements and to be positioned at said recess portion.

4. The adjustable falling foot support device, as recited in claim 2, wherein said fixing arrangement comprises a belt slot arranged on a periphery of said shell and a fastening belt penetrating said belt slot, wherein one end of said fastening belt has a buckle to buckle another end of said fastening belt after tied safety harness, so as to detachably buckle said shell to the safety harness.

5. The adjustable falling foot support device, as recited in claim 2, wherein said first guiding groove is arranged on a top of said second plate, wherein said opening on a top of said compartment comprises a screw cap covered thereon to hide said belt pulley, wherein a periphery of said screw cap extends downward to provide a rim pivotally connected with said shell, wherein said screw cap further has a mounting hole pivotally connected with a top end of said axis, a control button arranged on a top thereof, and a second guiding groove corresponding to said first guiding groove, wherein a top margin of said slider slidingly arranged in said second guiding groove, wherein said control button is screwingly fixed on a top of said slider with a locking bolt, such that said screw cap and said belt pulley are allowed to integrally autorotate and said control button is able to drive said slider to shift between said first position and said second position.

6. The adjustable falling foot support device, as recited in claim 5, wherein a center of said base plate has a spline hole penetrated in a stair shaped manner, wherein a bottom end of said axis has a nut head matching said spline hole and the top end of said axis respectively has a screw hole and a retaining lip, wherein said belt pulley has a mid hole pivoted by said axis, wherein said trunk further comprises a shoulder encircling portion protruding from a inner periphery of the top margin thereof around said compartment, wherein said shoulder encircling portion has said plurality of blocks thereon, wherein a bottom of said screw cap presses against block of said plurality of blocks, so as to allow said rim to be pivotally connected with an outboard of said shoulder encircling portion, wherein a bottom of said mounting hole limits said retaining lip on top of said axis, wherein a stopping bolt pivots through said mounting hole to be locked on said screw hole on top of said axis, so as to control said screw cap to autorotate around said stopping bolt and said axis.

7. The adjustable falling foot support device, as recited in claim 5, wherein said shell further comprises a recess portion formed on an outboard around said belt outlet and a plurality of magnetic elements thereon, wherein said second end of said main belt comprises a forcing portion affixed thereon so as to restrict said second end of said main belt from being withdrawn into said compartment, wherein said forcing portion is magnetic conductible so as to be attracted by said magnetic elements and to be positioned at said recess portion.

8. The adjustable falling foot support device, as recited in claim 5, wherein said fixing arrangement comprises a belt slot arranged on a periphery of said shell and a fastening belt penetrating said belt slot, wherein one end of said fastening belt has a buckle to buckle another end of said fastening belt after tied safety harness, so as to detachably buckle said shell to the safety harness.

9. The adjustable falling foot support device, as recited in claim 5, wherein said slider comprises a first clip portion, wherein said screw cap further comprises a second clip portion that matches said first clip portion, such that said first clip portion and said second clip portion limit each other by providing a preload.

10. The adjustable falling foot support device, as recited in claim 9, wherein a center of said base plate has a spline hole penetrated in a stair shaped manner, wherein a bottom end of said axis has a nut head matching said spline hole and the top end of said axis respectively has a screw hole and a retaining lip, wherein said belt pulley has a mid hole pivoted by said axis, wherein said trunk further comprises a shoulder encircling portion protruding from a inner periphery of the top margin thereof around said compartment, wherein said shoulder encircling portion has said plurality of blocks thereon, wherein a bottom of said screw cap presses against block of said plurality of blocks, so as to allow said rim to be pivotally connected with an outboard of said shoulder encircling portion, wherein a bottom of said mounting hole limits said retaining lip on top of said axis, wherein a stopping bolt pivots through said mounting hole to be locked on said screw hole on top of said axis, so as to control said screw cap to autorotate around said stopping bolt and said axis.

11. The adjustable falling foot support device, as recited in claim 9, wherein said fixing arrangement comprises a belt slot arranged on a periphery of said shell and a fastening belt penetrating said belt slot, wherein one end of said fastening belt has a buckle to buckle another end of said fastening belt after tied safety harness, so as to detachably buckle said shell to the safety harness.

12. The adjustable falling foot support device, as recited in claim 1, wherein said shell further comprises a recess portion formed on an outboard around said belt outlet and a plurality of magnetic elements thereon, wherein said second end of said main belt comprises a forcing portion affixed thereon so as to restrict said second end of said main belt from being withdrawn into said compartment, wherein said forcing portion is magnetic conductible so as to be attracted by said magnetic elements and to be positioned at said recess portion.

13. The adjustable falling foot support device, as recited in claim 9, wherein said shell further comprises a recess portion formed on an outboard around said belt outlet and a plurality of magnetic elements thereon, wherein said second end of said main belt comprises a forcing portion affixed thereon so as to restrict said second end of said main belt from being withdrawn into said compartment, wherein said forcing portion is magnetic conductible so as to be attracted by said magnetic elements and to be positioned at said recess portion.

14. The adjustable falling foot support device, as recited in claim 1, wherein said fixing arrangement comprises a belt slot arranged on a periphery of said shell and a fastening belt penetrating said belt slot, wherein one end of said fastening belt has a buckle to buckle another end of said fastening belt after tied safety harness, so as to detachably buckle said shell to the safety harness.

* * * * *